United States Patent [19]

Morrow

[11] 4,248,207

[45] Feb. 3, 1981

[54] STOVE, STEAM COOKING AND HEATING SYSTEM

[76] Inventor: Herbert Morrow, R.D. 1, Greenwich, Ohio 44837

[21] Appl. No.: 34,022

[22] Filed: Apr. 27, 1979

[51] Int. Cl.[3] ..... F24H 1/18; F24C 13/00; F24D 1/00

[52] U.S. Cl. ..... 126/348; 126/5; 126/369

[58] Field of Search ..... 126/5, 369, 369.1, 369.2, 126/369.3, 355, 348

[56] References Cited

U.S. PATENT DOCUMENTS

| | | | |
|---|---|---|---|
| 2033 | 4/1881 | Munger et al. | 126/348 |
| 964,913 | 7/1910 | Wallace | 126/39 D |
| 1,053,812 | 2/1913 | Hickerson | 126/348 |
| 1,527,498 | 2/1925 | Wallace | 126/5 |
| 1,958,590 | 5/1934 | Peirce | 126/369 |
| 2,034,473 | 3/1936 | Kitamura | 126/348 |
| 3,192,916 | 7/1965 | Vitkay | 126/5 |
| 3,823,657 | 7/1974 | Louetolf | 99/337 |
| 3,905,352 | 9/1975 | Jahn | 126/425 |

*Primary Examiner*—Samuel Scott
*Assistant Examiner*—Wesley S. Ratliff, Jr.
*Attorney, Agent, or Firm*—Sherman Levy

[57] ABSTRACT

A stove, steam cooking and heating system is provided that includes a means for supplying water to a collector wherein the collector is arranged in a suitable location such as a heat source such as a fireplace, campfire or the like so that the water is converted to steam which can be used for any desired purpose, as for example, the steam can be used for cooking foodstuffs, heating purposes and the like.

2 Claims, 6 Drawing Figures

STOVE, STEAM COOKING AND HEATING SYSTEM

FIELD OF THE INVENTION

Prior U.S. Pat. Nos. such as 964,913; 2,034,473; 3,823,657 and 3,905,352 have been provided for using steam for various purposes. However, neither these prior patents nor any others known to applicant accomplish the results achieved by the present invention.

BACKGROUND OF THE INVENTION

The present invention relates to a stove, steam cooking and heating system wherein a quantity of water is permitted to flow to a collector, and wherein the collector is arranged in a suitable location such as adjacent to a heat source such as a fireplace, campfire, and the like, so that the water entering the collector is converted to steam and whereby this steam can then be used for any desired purpose, as for example the steam can be used for cooking foods, heating rooms or the like.

SUMMARY OF THE INVENTION

The present invention is directed to a stove, steam cooking, and heating system wherein the device is portable, and wherein the device can be easily assembled or disassembled, the device being easy and efficient to use and operate.

The primary object of the present invention is to provide a stove, steam cooking and heating system which will permit or assure important fuel savings by utilizing heat that is otherwise wasted for valuable purposes.

Still another object of the present invention is to provide a portable, easily assembled stove, steam cooking and heating system that is relatively simple and inexpensive to manufacture and operate.

Still another object of the present invention is to provide a stove, steam cooking and heating system which has improved characteristics and advantages as compared to previous devices.

Other objects and advantages of the present invention will become apparent in the following specifications when considered in the light of the attached drawings.

DESCRIPTION OF THE PREFERRED EMBODIMENTS

Referring in detail to the drawings, the numeral 20 indicates the stove, heating system, or the like, which includes a support frame structure 21 that embodies or includes a plurality of collapsible or knock-down legs 22, 23 and 24 that are arranged in spaced apart relation with respect to each other. Braces 25, 26 and 27 are connected to the legs by means of couplings 28.

Figure 1:
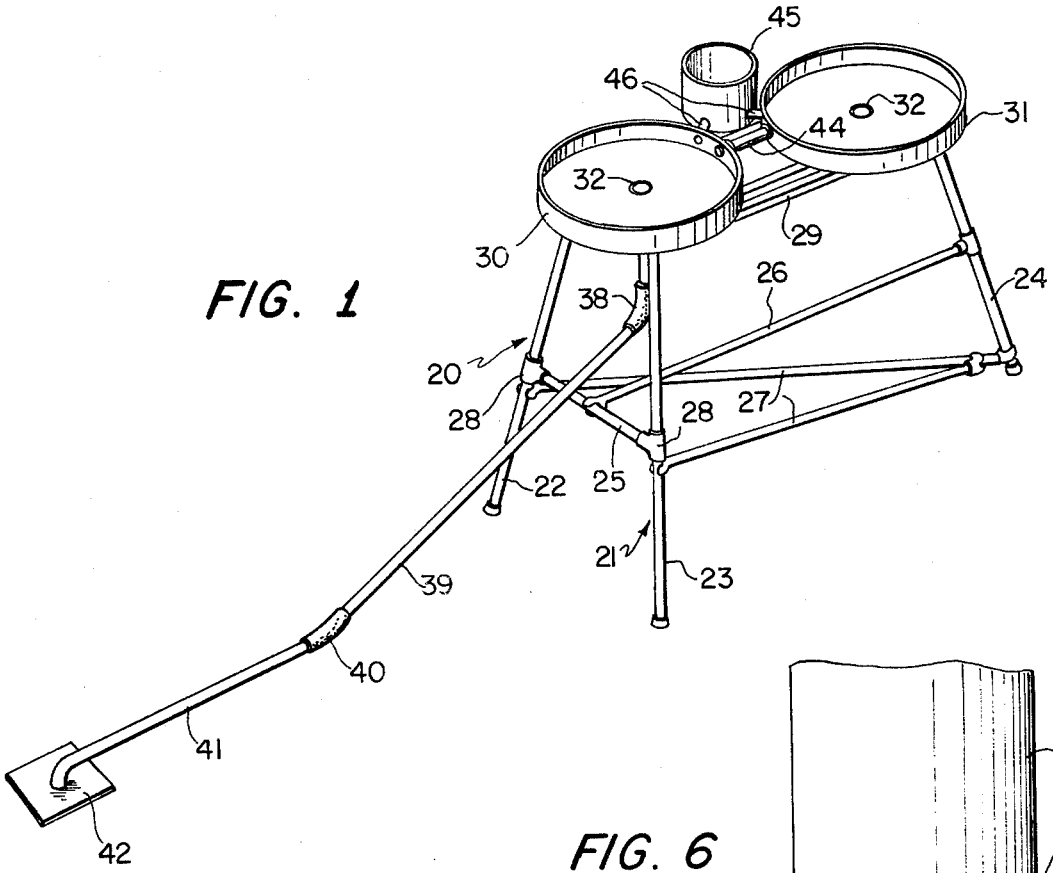
FIG. 1 is an overall perspective view of the stove, steam cooking and heating system of the present invention.
Figure 3:
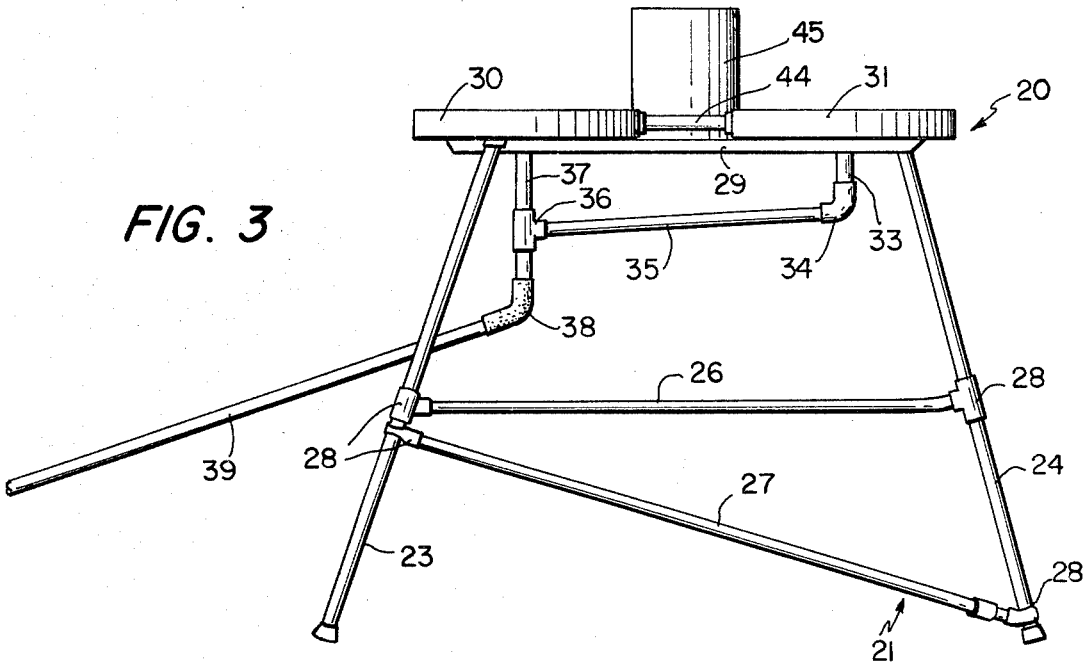
FIG. 3 is a side elevational view of the device.

There is further provided horizontally disposed cross pieces 29 which have horizontally disposed circular body members 30 mounted thereon and affixed thereto, and the circular hollow body members 30 are provided with central apertures or openings 32. The vertically disposed pipe section 33 depends from the aperture 32 as shown in FIG. 3, and an elbow 34 connects the pipe section 33 to pipe section 35, and the pipe section 35 is connected to a vertically disposed pipe section 37 by means of T-fitting 36. An elbow 38 on the lower end of the pipe section 37 connects the pipe section 37 to an inclined pipe section 39, and a flexible coupling 40 connects the pipe section 39 to a pipe section 41, the hollow pipe section 41 having a collector plate 42 secured to the end thereof as shown in FIG. 1. The flat collector plate 42 is adapted to be positioned in a suitable source of heat such as a campfire, chimney or the like, so that water, dripping down through the pipes, will be converted into steam at the heated collector 42 and this steam will be caused to travel upwardly in the pipe sections so that such steam can be used for cooking purposes, heating, or the like.

The numeral 43 indicates a hollow body member in the form of a bucket, pail, or the like, and a conduit 44 interconnects the pair of members 30 together. There is further provided a hollow container 45 which is in communication with the members 30 by means of conduits or pipes 46.

Figure 4:
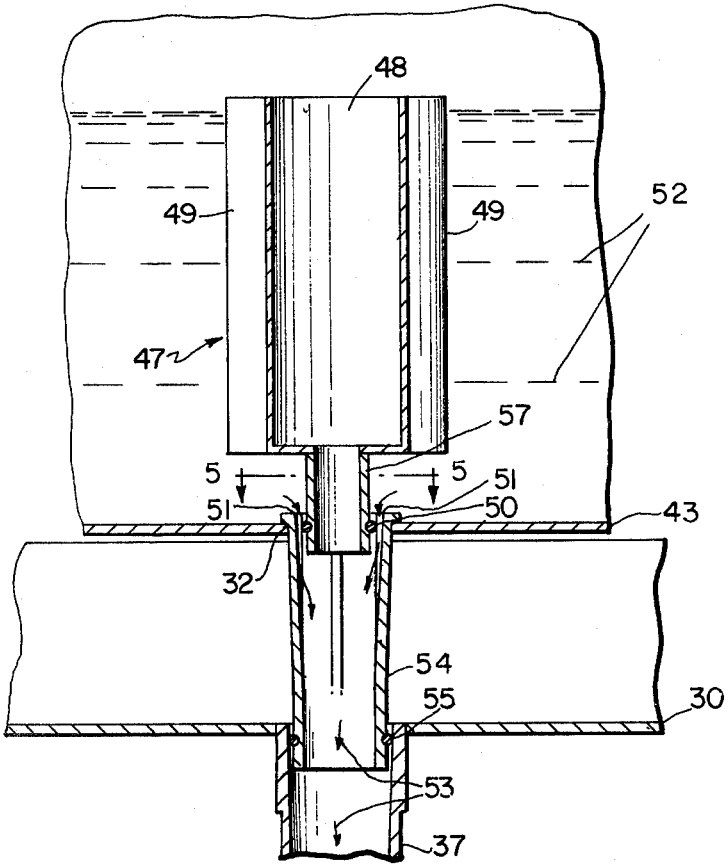
FIG. 4 is an enlarged sectional view taken on the line 4—4 of FIG. 2.
Figure 5:
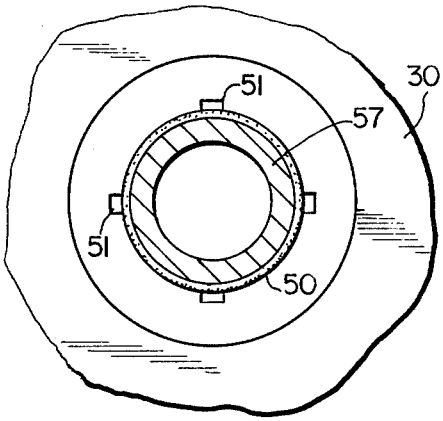
FIG. 5 is an enlarged sectional view taken on the line 5—5 of FIG. 4.

A bracket or bushing assembly 47 is mounted in the member 43, and the assembly 47 includes a centrally disposed hollow tubular member 48 that has a plurality of spaced apart open ended pipe-like members 49 secured to its outer periphery. A fitting 57 depends from the bracket assembly 47 as shown in FIG. 4, and the fitting 57 projects into a pipe element 54, there being an "O" ring 50 arranged as shown in the drawings. Slots 51 are provided so that water 52 can flow by gravity down through the slots 51 and then through the member 54, and this water can then flow downwardly through the pipe sections 39 and 41 so that the water will be converted into steam by the heated collector 42 whereby the steam will then be caused to pass back upwardly through the pipe sections 41 and 39 so that such steam can be used for various useful purposes.

In FIG. 4 the numeral 53 arrows which show the direction of water flowing downwardly through the pipe members, and "O" ring 55 is positioned as shown, so that the parts will be maintained with a proper fit.

From the foregoing, it will be seen that there has been provided a stove, heating system or the like, and in use with the parts arranged as shown in the drawings, the stove or heating system 20 includes a collapsible supporting frame 21 that consists of the legs such as the legs 22, 23 and 24 that are interconnected by detachable braces 25, 26 and 27. Interconnecting pipes or conduits 35, 36, 37, 39 and 41 are provided, and the pipe 41 has a flat metal collector plate 42 on the lower end thereof. The elbows or couplings 38 and 40 are flexible so that the collector plate 42 can be positioned in different locations, as for example the collector plate 42 can be arranged in a fireplace, campfire, or the like.

With the parts assembled as shown in the drawings, and with a quantity of water 52 in a member such as the member 43, some of this water can drip or flow downwardly by gravity through the slots 51 and this water will then pass downwardly through the pipe section 54 and then through the conduit such as the conduit or pipe 37 or 33, and the water will then flow downwardly by gravity to the pipe section 39, then through the pipe section 41 until it reaches the heated collector plate 42 at which time this water is converted into steam and the steam will pass back upwardly through the pipes 41 and 39 so that the steam will be able to recirculate or reenter a member such as the member 30 or 31 whereby foodstuffs in pans and the like thereon can be heated and cooked. Or, the steam can be used for heating a room, tent or other area.

The parts can be made of any suitable material and in different shapes and sizes as designed or required.

When the device is not being used, the various pipe sections or legs can be disconnected or dissembled so that the entire unit will occupy a minimum amount of space for storage or shipment.

Figure 6:
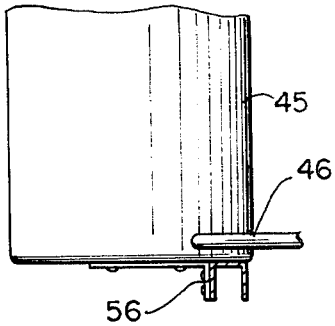
FIG. 6 is a fragmentary elevational view showing a container that is used to feed water to the device.
Figure 2:
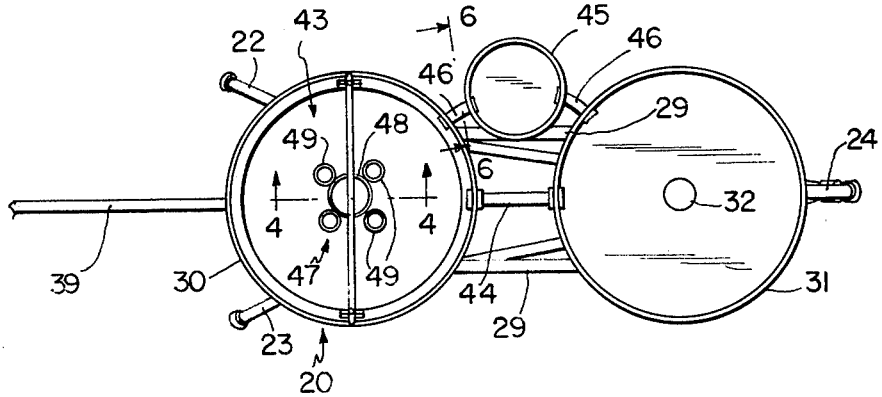
FIG. 2 is a top plan view and showing one of the bucket-like members mounted in position thereon.

There is further provided a container 45 which can be used for holding a quantity of water, and water from the container 45 can enter the members 30 and 31 through the conduits 46. A member such as the member 43 can be arranged on either or both of the elements 30 and 31. The members 30 and 31 are interconnected together by a conduit 34 so that these various conduits are provided whereby the water pressure and steam will be equalized as it flows through the system. The container 45 is adapted to be supported by means of a bracket 56, FIG. 6.

It will therefore be seen that there has been provided a stove, steam cooking and heating system which is in the form of a portable device that can be easily and quickly assembled or disassembled and wherein the device can be in operation in a short period of time. The device can be used for cooking as well as for heating water thereon, and in addition surgical instruments can be sterilized, pure water can be produced by condensing the steam for drinking and the like. The device can be used by the armed forces, civil defense in disaster areas, or other locations. The collector without the burners could be used to transfer heat from any source to any place needed using any fuel available. The collector can be used to heat an automobile from the exhaust waste heat as well as providing energy, and solar energy can be used in conjunction therewith. The collector 42 can be used in fireplaces, stovepipes, furnace pipes, and the like to collect the waste heat that normally escapes up the chimney and that heat can be used in various places in the home, so that the present invention will permit important fuel savings. With the collector connected to a radiator, the device can be used to heat a tent, trailer or other member. The device can be used for many different purposes, such as heating and cooking and is simple and inexpensive to manufacture and operate.

With the present invention, waste heat that is ordinarily lost up a chimney can be utilized to place the heat where needed in a house or building, and the present invention is especially advantageous as an energy saving member.

A pan or other unit having foodstuffs therein can be placed on the members 30 or 31 so that such foodstuffs as desired can be heated and cooked by steam. If desired, more than two of the members 30 and 31 can be utilized, or if desired, only one of such members can be used. Plastic can be used where feasible. Hot water and steam can be used that is produced so that such hot water and steam can be used for washing dishes or other purposes.

The present invention provides efficient heat as well as convenient heat that is safe and inexpensively produced. The device is easily cleaned and folds up for compact storage.

If desired, suitable accessories can be provided for the unit, and for example, valves can be provided for controlling the flow of water and steam. The device can be used for civil defense purposes. The pipes 49 are adapted to be made of a suitable material such as copper and these pipes 49 help assure that the heat will be properly distributed during use of the device. The device can be used in conjunction with a furnace or other member. A coffee pot and the like can be readily heated. When the device is being used, the water seeps down through the pipes and returns as steam, and such steam can be used for heating food, or for heating a room, tent, or the like.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. A portable knock down stove, steam cooking and heating system comprising a supporting frame structure including legs, a pair of circular horizontally disposed hollow body members mounted above said supporting frame, a conduit interconnecting said body members together, a hollow container on at least one of said body members, a pipe like member depending from said container, there being apertures in the central portion of said body members for selectively receiving said last named hollow member, a bushing assembly including a depending neck, a plurality of spaced apart tubular members affixed to said bushing assembly, there being a space betweeen the lower ends of said bushing assembly and the bottom of said container, said container adapted to hold a quantity of water therein, there being a plurality of spaced apart slots permitting the water to flow downwardly therethrough, a single conduit means for the passage therethrough of water, a collector on the lower end of said conduit means, and said collector adapted to be placed in a heat source.

2. The structure as defined in claim 1 wherein water can flow downward through the conduit means into engagement with the heated collector so that the water is converted into steam, and wherein the water can pass downwardly, and the steam can pass upwardly through the same conduit means so that the steam can be used for cooking and heating purposes and the like.

* * * * *